United States Patent [19]

Blaisdell et al.

[11] Patent Number: 4,937,487

[45] Date of Patent: Jun. 26, 1990

[54] PICTURE ELEMENT LAMP ASSEMBLY FOR INFORMATION DISPLAY SYSTEM

[75] Inventors: Ronald G. Blaisdell, Saugus; Harold L. Hough, Beverly; Thomas Haraden, Ipswich, all of Mass.

[73] Assignee: GTE Products Corporation, Danvers, Mass.

[21] Appl. No.: 232,827

[22] Filed: Aug. 16, 1988

[51] Int. Cl.[5] ..... H01J 61/00; H01J 61/94; H01J 61/32; H01J 61/96

[52] U.S. Cl. ..... 313/318; 313/1; 313/44; 313/49; 313/51; 315/56; 315/324

[58] Field of Search ..... 313/1, 49, 51, 318, 313/493; 439/226, 227, 228, 229; 315/56, 57, 58, 324, 317

[56] References Cited

U.S. PATENT DOCUMENTS

| | | | |
|---|---|---|---|
| 2,401,228 | 5/1946 | Noel | 313/318 |
| 2,451,900 | 10/1948 | Zambakian et al. | 313/318 |
| 4,426,602 | 1/1984 | Mollet et al. | 315/58 |
| 4,481,442 | 11/1984 | Albrecht et al. | 313/493 |
| 4,559,480 | 12/1985 | Nobs | 314/324 |
| 4,625,152 | 11/1986 | Nakai | 315/324 |
| 4,746,840 | 5/1988 | Lim | 313/318 |
| 4,825,128 | 4/1989 | Sprengers | 313/318 |

FOREIGN PATENT DOCUMENTS

| | | | |
|---|---|---|---|
| 0022977 | 2/1979 | Japan | 439/227 |
| 62-31937 | 2/1987 | Japan | 2145873A/071984 |
| 2145873A | 7/1984 | United Kingdom . | |
| 2167895A | 7/1985 | United Kingdom . | |

*Primary Examiner*—Stuart S. Levy
*Assistant Examiner*—Yolanda B. Harris
*Attorney, Agent, or Firm*—Wolf, Greenfield & Sacks

[57] ABSTRACT

A plug-in lamp assembly for use as a picture element in an information display screen includes a plurality of low-pressure arc discharge lamps for selectively generating multiple colors, a lamp plug for interconnection and mounting of the discharge lamps, and a lamp socket for plug-in attachment of the lamp plug. Each discharge lamp has electrical leads extending from a first end thereof and a light output region at a second end thereof. The lamp plug comprises a base having spaced-apart electrical connector pins and a cap attached to the base. The first ends of the discharge lamps extend through openings in the top wall of the cap into the lamp plug, and selected electrical leads are coupled to the electrical connector pins. The lamp plug and the lamp socket include openings for directing cooling air over the first ends of the discharge lamps. The cooling air is preferably directed from the rear of the display screen through the lamp socket and the lamp plug and is exhausted through the front of the display screen. The lamp socket preferably includes an upstanding locating projection and a spring clip for retaining the lamp plug.

14 Claims, 4 Drawing Sheets

PICTURE ELEMENT LAMP ASSEMBLY FOR INFORMATION DISPLAY SYSTEM

FIELD OF THE INVENTION

This invention relates to lamp assemblies for use in very large screen display systems and, more particularly, to plug-in lamp assemblies that include red, green and blue low pressure arc discharge lamps. Each of the lamp assemblies is a picture element of the display system.

BACKGROUND OF THE INVENTION

Low-pressure arc discharge lamps have been used for optical display of information, including alphanumerics, graphics and moving or still pictures, on a large screen. Such a display consists of a matrix of picture elements, or pixels. Each picture element includes a monochrome light source in the case of a monochrome display. In the case of a color information display, each picture element includes three lamps of the primary colors: red, green and blue. Each lamp is selectively energized on a scale ranging from off to full brightness to produce one of the primary colors or a mixture of primary colors for that picture element.

A large screen display of the above-described type is disclosed in U.S. Pat. No. 4,559,480, issued Dec. 17, 1985 to Nobs. the disclosed display utilizes picture elements each consisting of three discharge tubes coated with different phosphors to produce the primary colors. The disclosed display has sufficient brightness for use in outdoor sports stadiums and the like during the daytime. Such displays have typically utilized compact, generally U-shaped fluorescent lamps that are primarily used for general illumination. The envelope includes at least two longitudinally-extending tubes joined together by a transversely-extending envelope portion. Examples of such lamps which are commercially available are the "twin tube" and "double twin tube" fluorescent lamps manufactured by GTE Sylvania, Danvers, Mass. Other examples of such lamps are disclosed in U.S. Pat. No. 4,426,602, issued Jan. 17, 1984 to Mollet et al and U.S. Pat. No. 4,481,442, issued Nov. 6, 1984 to Albrecht et al. Low-pressure arc discharge lamps wherein a large portion of the light emitted from the lamp is directed through end faces of parallel tubes are disclosed in pending application Ser. Nos. 064,978, 064,961 and 064,731, filed June 22, 1987, and assigned to the assignee of the present application. The disclosed lamps can include different color phosphors.

A large screen picture display of the type used in a sports stadium consists of several thousand picture elements, each including three discharge lamps. In the past, the discharge lamps have been individually soldered to circuit boards located at the rear of the display. When one or more of the lamps in the display failed, it was necessary to remove an entire circuit board from the display, to unsolder and remove the defective bulb and then to solder a new lamp in its place. Finally, the circuit board was replaced in the display. Such a procedure was found to be inconvenient in the environment of a sports stadium. The use of connectors for single U-shaped fluorescent lamps is disclosed in the aforementioned Pat. Nos. 4,426,602 and 4,481,442. Such single connectors are not satisfactory for use in picture displays due to the spacing between lamps necessitated by the dimensions of the plug-in base. In order to form a picture element having a satisfactory appearance, it is necessary for the red, green and blue lamps to be closely spaced or in contact with each other. Any significant spacing between the lamps of a pixel degrades the apparent uniformity of the picture display. Furthermore, single lamp connectors are inconvenient in the case of a large screen display due to the large number of single lamps and the possibility of replacing a lamp with the wrong color.

A further consideration which large screen picture displays is temperature control. Although compact fluorescent lamps are relatively efficient in comparison with other light sources, significant heat is produced when several thousand such lamps are operated in close proximity in a large screen display. The heat is generated primarily at the filament end of the lamp.

It is a general object of the present invention to provide picture element lamp assemblies for use in large screen information display systems.

It is another object of the present invention to provide a plug-in picture element lamp assembly containing red, green and blue discharge lamps.

It is a further object of the present invention to provide a plug in picture element lamp assembly including means for directing cooling air over the discharge lamps.

It is a further object of the present invention to provide a picture element lamp assembly that is easily replaceable.

It is still another object of the invention to provide a picture element lamp assembly having a combination of the above features.

SUMMARY OF THE INVENTION

According to the present invention, these and other objects and advantages are achieved in a plug-in lamp assembly for use as a picture element in an information display system. The lamp assembly comprises a plurality of low-pressure arc discharge lamps for selectively generating multiple colors, and a lamp plug for interconnection and mounting of the discharge lamps. Each discharge lamp has electrical leads extending from a first end thereof and a light output region at a second end thereof. The lamp plug comprises a base having spaced-apart electrical connector pins mounted therein and a cap attached to the base. The cap has a top wall provided with lamp-receiving openings and side walls interconnecting the top wall and the base. The first ends of the discharge lamps extend through the openings in the top wall into the lamp plug, and selected ones of the electrical leads of the discharge lamps are coupled to the electrical connector pins. Preferably, the plurality of discharge lamps includes a red discharge lamp, a green discharge lamp and a blue discharge lamp. Each of the discharge lamps is preferably a U-shaped, compact fluorescent lamp.

The lamp assembly further includes a lamp socket for plug-in attachment of the lamp plug. The lamp socket includes circuit board-mountable electrical contacts for interconnection with the connector pins of the lamp plug.

According to one feature of the invention, the lamp plug and the lamp socket each include means for directing cooling air over the first ends of the discharge lamps. The means for directing cooling air can include openings in the lamp socket, in the base and in the top wall of the cap. Cooling air is directed from the rear of the display screen through the lamp socket and the lamp plug, passes over the first ends of the discharge lamps and is exhausted through the front of the display screen.

According to another feature of the lamp assembly, the lamp socket includes an upstanding locating projection, and the base includes a recess for receiving the locating projection. The locating projection is keyed to facilitate correct orientation of the lamp plug relative to the lamp socket. The lamp assembly of the present invention permits the discharge lamps of a picture element to be mounted in close proximity and permits a picture element to be easily replaced.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

Figure 1:
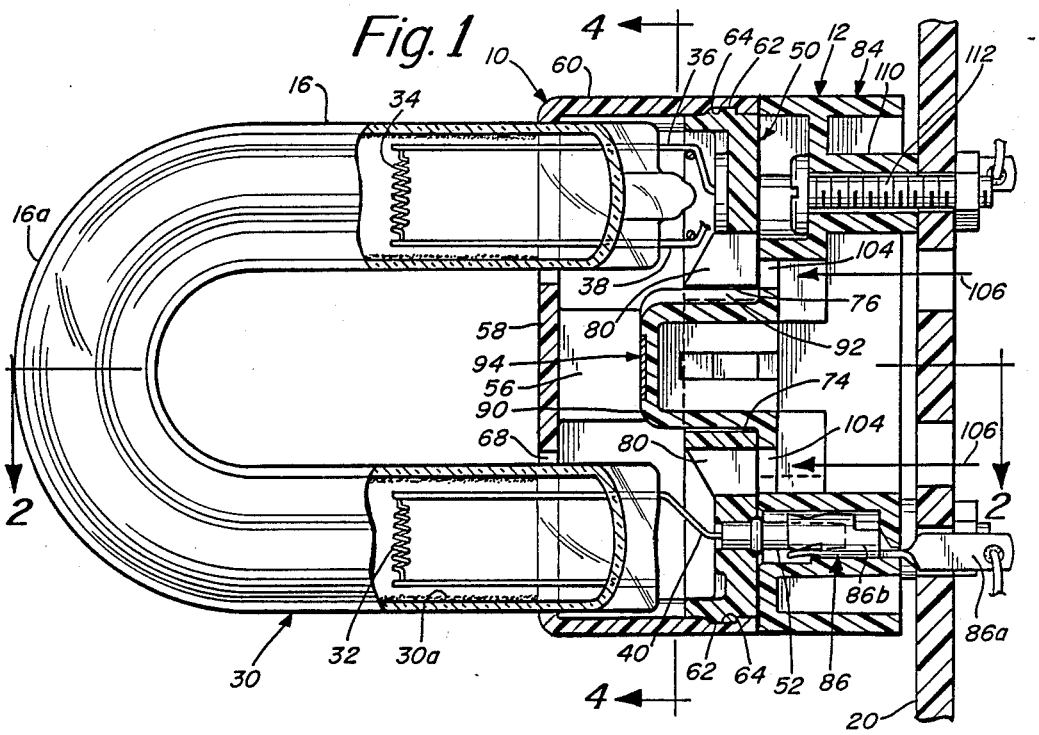
FIG. 1 is a partial cross-sectional side view of the lamp assembly of the present invention.
Figure 2:
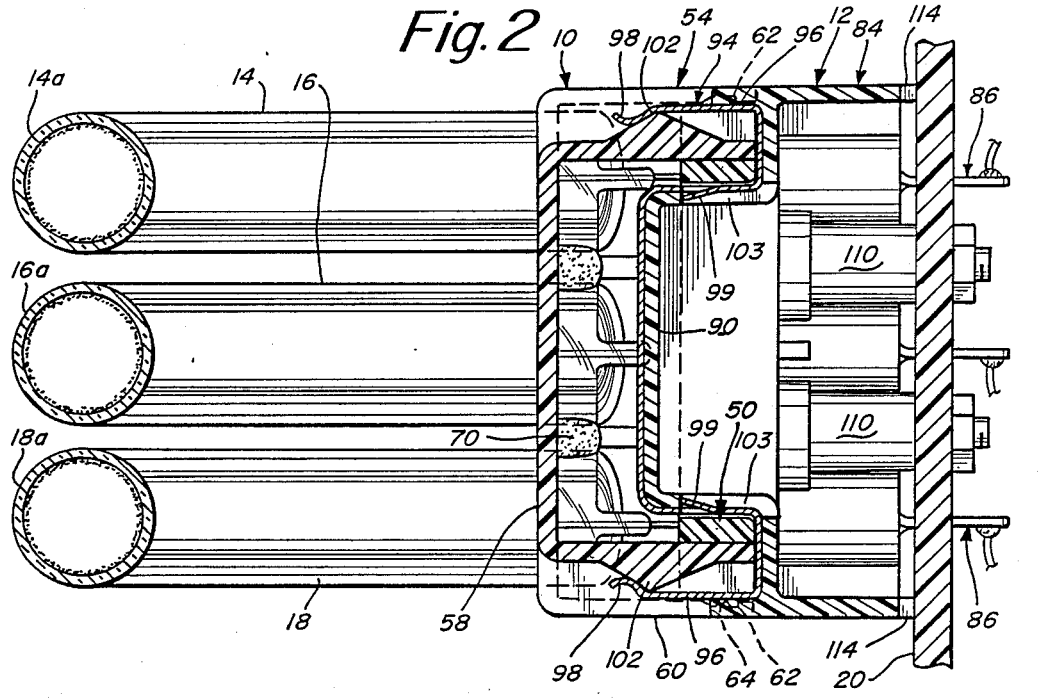
FIG. 2 is a cross-sectional plan view of the lamp assembly taken along the line 2—2 of FIG. 1.

The lamp assembly of the present invention is illustrated in FIGS. 1–7. A plurality of low pressure discharge lamps are mounted in a lamp plug 10 adapted for engagement with a lamp socket 12. The discharge lamps include a red discharge lamp 14, a green discharge lamp 16 and a blue discharge lamp 18 in a closely spaced, side-by-side configuration. The lamp socket 12 is preferably mounted on a printed circuit board 20 of a large screen display. The lamp assembly forms a picture element of the display that can easily be replaced when one or more of the discharge lamps fails. Each of the discharge lamps 14, 16, 18 is selectively energized at a level between off and full brightness to produce one of the primary colors or a mixture of primary colors for that picture element.

The discharge lamps 14, 16, 18 are preferably compact, low-pressure, fluorescent lamps such as type A218 manufactured by GTE Products Corporation. Each discharge lamp includes a sealed, generally U-shaped envelope 30 containing an ionizable medium including a quantity of mercury and an inert starting gas at low pressure. The envelope 30 can, for example, contain on the order of 1 to 5 millimeters of mercury, and the starting gas can be argon, krypton, neon or helium or a mixture of these and other gases. A phosphor layer on the inside surface **30*a* of envelope 30** converts ultraviolet radiation generated in the mercury discharge into visible radiation. It will be understood that other low-pressure arc discharge lamps can be utilized in the lamp assembly of the present invention. For example, suitable low-pressure discharge lamps are disclosed in the aforementioned application Ser. Nos. 064,978, 064,961 and 064,731.

Electrodes 32 and 34 (FIG. 1) are located at opposite ends of U-shaped envelope 30 for generating an arc discharge therebetween during operation of the lamp. Electrode 32 is an anode, and electrode 34 is a filament-type cathode. During operation, constant electrical energy is supplied to filament electrode 34, and lamp intensity is controlled by varying the current applied to electrode 32. Electrical leads 36 and 38 are connected to electrode 34, and electrical lead 40 is connected to electrode 32. The electrical leads 36, 38, 40 extend from a first end of each of the discharge lamps 14, 16, 18. The light output from the discharge lamps is provided through second ends **14*a*, 16*a*, 18*a* of the respective discharge lamps. The second ends 14*a*, 16*a*, 18*a*** of the discharge lamps are located at the curved, middle portion of the U-shaped envelopes.

Figure 3:
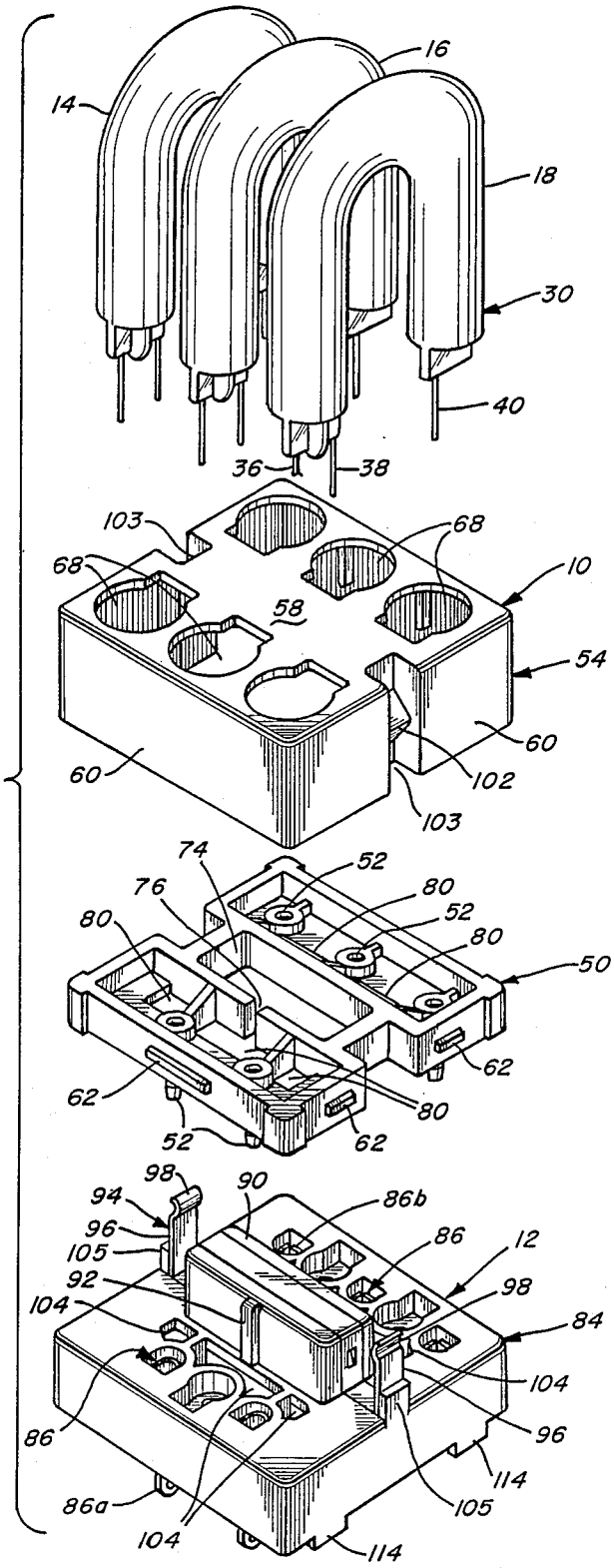
FIG. 3 is an exploded perspective view of the components of the lamp assembly.
Figure 4:
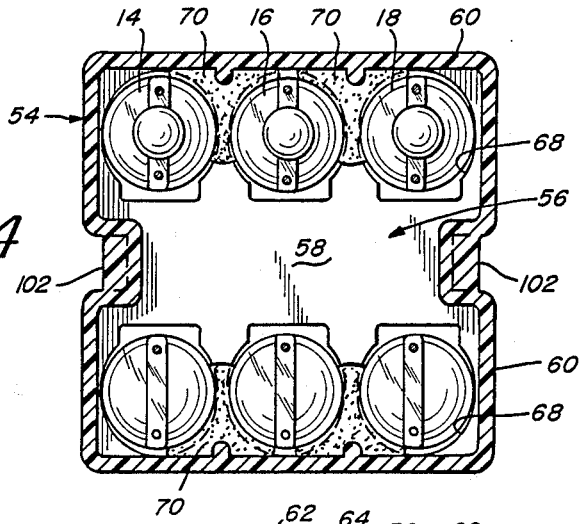
FIG. 4 is a cross-sectional view of the lamp plug and discharge lamps taken along the line 4—4 of FIG. 1.
Figure 5:
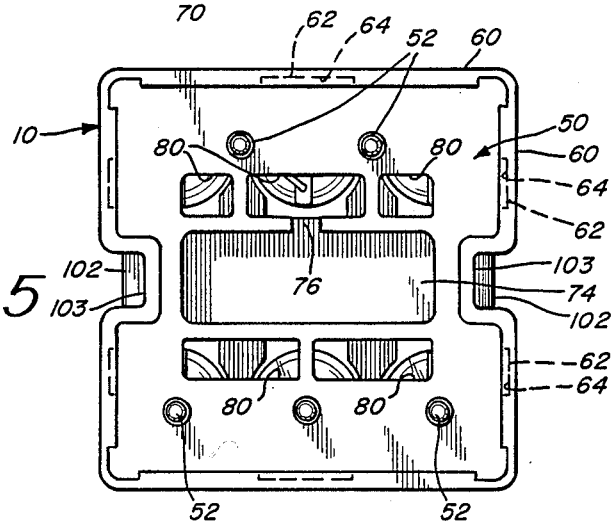
FIG. 5 is a rear elevational view of the lamp plug.

As best shown in FIGS. 3–5, the lamp plug 10 includes a base 50 having electrical connector pins 52 mounted therein and a cap 54 that attaches to the base 50 and defines an interior region 56 of the lamp plug 10. The cap 54 includes a top wall 58 and side walls 60 extending generally perpendicular to the top wall 58 around the periphery thereof. The side walls 60 preferably snap on to the base 50 to form the lamp plug 10. In a preferred embodiment, the base 50 is provided with outwardly-projecting ribs 62, and the side walls 60 are provided with grooves 64 that interengage with ribs 62. It will be understood that the positions of the ribs 62 and the grooves 64 can be interchanged, or any other suitable snap fit means can be utilized.

The top wall 58 includes a plurality of lamp receiving openings 68, preferably having a D-shape or a keyhole shape. The first ends of the discharge lamps 14, 16, 18 extend through openings 68 into the interior region 56 of lamp plug 10. Also, cooling air is directed through openings 68 as described hereinafter. Each of the discharge lamps 14, 16, 18 is held in position in lamp plug 10 by lamp basing cement 70 in interior region 56. The cement should be located between lamps 14, 16, 18 and side walls 60 so that air flow through the center portion of interior region 56 is not blocked.

Electrical connector pins 52 are mounted in apertures in base 50 and provide means for plug-in electrical connection of the lamp assembly. The connector pins 52 mechanically support the lamp assembly in the lamp socket 12. In addition, connector pins 52 carry power for energizing the discharge lamps 14, 16 and 18. The connector pins 52 can be of the hollow type. The leads from the appropriate discharge lamps are inserted into the hollow connector pins 52 and are either soldered or crimped to form permanent electrical connections.

In order to energize three discharge lamps of the type described above, five connector pins 52 are required. The filaments of each lamp are commonly connected to a source of electrical energy. The filaments can be connected in series, but are preferably connected in parallel so that the failure of one filament does not affect operation of the other lamps. Three other connector pins 52 are required for individually energizing the anode electrodes of each of the lamps 14, 16, 18.

The base 50 further includes a keyed opening 74 for receiving a keyed locating projection on the lamp socket. The keyed opening 74 is generally rectangular and includes a notch 76 for engaging with a key on the locating projection. The base 50 further includes air flow openings 80 for circulation of cooling air as described hereinafter.

Figure 6:
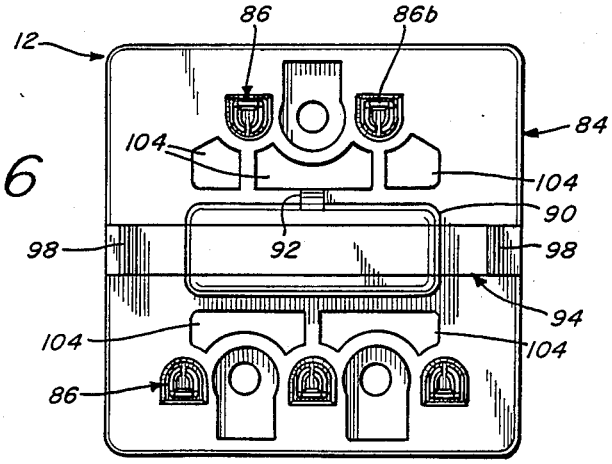
FIG. 6 is a front elevational view of the lamp socket.
Figure 7:
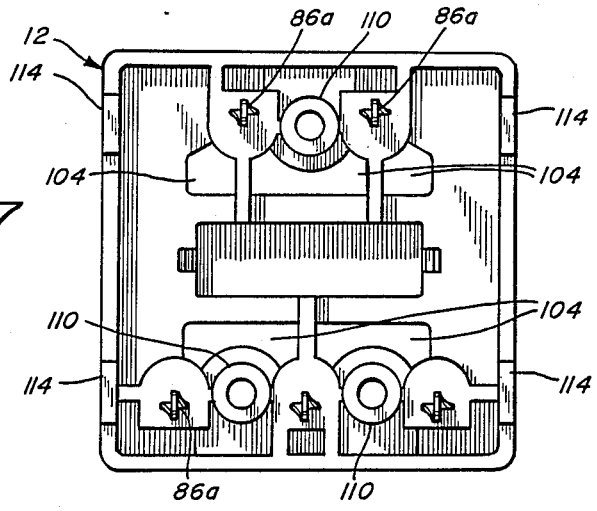
FIG. 7 is a rear elevational view of the lamp socket.

The lamp socket 12, as best shown in FIGS. 3, 6 and 7, includes a low profile body 84 having apertures for mounting of electrical contacts 86. The electrical contacts 86 include portions 86a extending from body 84 for attachment to printed circuit board 20 and portions 86b for engaging with connector pins 52. The side of lamp socket 12 that engages with lamp plug 10 includes an upstanding locating projection 90. In a preferred embodiment, the locating projection 90 is generally rectangular in shape and includes a locating key 92. The locating projection 90 has a sufficient height to require proper orientation of the lamp plug 10 and lamp socket 12 before connector pins 52 engage contacts 86. The locating projection 90 interengages with keyed opening 74 and locating key 92 engages notch 76 in base 50. The locating projection 90 facilitates orientation of the lamp plug 10 with lamp socket 12 for easy installation and replacement of picture elements.

The lamp socket 12 further includes a spring clip 94 to assist in retaining lamp plug 10 and lamp socket 12 together in the display system. By use of spring clip 94, it is not necessary to rely on friction between connector pins 52 in lamp plug 10 and contacts 86 in lamp socket 12 for mechanical support of the lamp assembly. In a preferred embodiment, the spring clip 94 extends over the top of locating projection 90 and includes U-shaped portions 96 at each end. The inner legs of U-shaped clip portions 96 have inwardly bent tabs 99 (FIG. 2) that engage with slots 101 in projection 90 for retaining the spring clip 94 in place. The outer legs of U-shaped clip portions 96 each include an inward projection 98 which engages with suitably located outward projections 102 on cap 54. Preferably, projections 102 are located in grooves 103 on opposite sides of cap 54. The outward projections 102 include sloping sides to permit easy installation of lamp plug 10 while inhibiting the lamp plug 10 from being removed after installation. The lamp socket 12 includes on its outer edges upwardly extending spring stiffeners 105 (FIG. 3) which, along with the outer legs of U-shaped clip portions 96, fit into grooves 103. Thus, the lamp plug 10 and the lamp socket 12 remain engaged in spite of vibration, loose electrical contacts, or the like. Preferably, the lamp plug 10 and/or the lamp socket 12 includes notches or other suitable means to facilitate use of a tool for removing the lamp plug 10 and the discharge lamps 14, 16, 18 from the lamp socket 12 without pulling directly on the discharge lamps 14, 16, 18.

Air flow openings 104 are provided in socket 12. Preferably, an air flow 106 (FIG. 1) is directed from the rear of the display screen toward the front through openings in printed circuit board 20. The cooling air flows through openings 104 in socket 12, through openings 80 in base 50 and through openings 68 in cap 54. Since the openings 68 are larger than the envelopes of lamps 14, 16, 18, cooling air flows through the portions of openings 68 not occupied by lamps 14, 16, 18 and around the ends of discharge lamps 14, 16, 18 where the electrodes are located. The air then flows toward the front of the display screen and is discharged. It will be understood that separate openings for cooling and for mounting of the discharge lamps can be provided, if desired.

The lamp socket 12 includes screw wells 110 (FIG. 1) for permanently mounting the socket 12 to the printed circuit board by means of screws 112, or other appropriate mounting hardware. The socket 12 is provided with short, downwardly-extending legs 114 (FIG. 3) which, together with screw wells 110, raise the socket above the printed circuit board 20 and allow air passage underneath the lamp assembly.

The lamp plug 10 and the lamp socket 12 are preferably fabricated by injection molding of a thermoplastic polyester such as, for example, GE Valox. The lamp plug 10 and the lamp socket 12 are preferably black for resistance to ultraviolet radiation.

While there has been shown and described what is at present considered the preferred embodiments of the present invention, it will be obvious to those skilled in the art that various changes and modifications may be made therein without departing from the scope of the invention as defined by the appended claims.

What is claimed is:

1. A plug-in lamp assembly for use as a picture element in an information display system, comprising:

a plurality of low-pressure arc discharge lamps for selectively generating multiple colors, each discharge lamp having electrical leads extending from a first end thereof and a light output region at a second end thereof; and a lamp plug for interconnection and mounting of said discharge lamps, comprising a base having spaced-apart electrical connector pins mounted therein, and a cap attached to said base, said cap having a top wall provided with lamp-receiving openings and side walls interconnecting said top wall and said base, the first ends of said discharge lamps extending through said openings into said lamp plug, the electrical leads of said discharge lamps being coupled to said electrical connectors for energizing said discharge lamps, said lamp plug including means for directing cooling air over the first ends of said discharge lamps, said means for directing cooling air including first air flow openings in said base and second air flow openings in said top wall, whereby cooling air flows through said first and second air flow openings and over the first ends of said discharge lamps.

2. A lamp assembly as defined in claim 1, wherein said second air flow openings are integral with said lamp-receiving openings.

3. A lamp assembly as defined in claim 1 wherein said plurality of discharge lamps includes a red discharge lamp, a green discharge lamp and a blue discharge lamp.

4. A lamp assembly as defined in claim 3 wherein said discharge lamps comprise generally U-shaped, compact fluorescent lamps.

5. A lamp assembly as defined in claim 1 further including lamp base cement for attaching said discharge lamps to said cap.

6. A lamp assembly as defined in claim 1 wherein said base and said cap include means for snap interengagement.

7. A lamp assembly as defined in claim 1 wherein said base includes a bottom surface from which said electrical connector pins project and wherein said base includes a recess for receiving a keyed locating projection.

8. A lamp assembly for use as a picture element in an information system, comprising:

a plurality of low-pressure arc discharge lamps for selectively generating multiple colors, each discharge lamp having electrical leads extending from a first end thereof and a light output region at a second end thereof;

a lamp plug for interconnection and mounting of said discharge lamps, comprising a base having spaced-apart electrical connector pins mounted therein, and a cap attached to said base, said cap having a top wall provided with lamp-receiving openings and side walls interconnecting said top wall and said base, the first ends of said discharge lamps extending through said openings into said lamp plug, the electrical leads of said discharge lamps being coupled to said electrical connectors for energizing said discharge lamps; and a lamp socket for attachment of said lamp plug, said lamp socket including circuit board-mountable electrical contacts for interconnection with the connector pins of said lamp plug, said lamp plug and said lamp socket each including means for directing cooling air over said discharge lamps, said means for directing cooling air including first air flow openings in said base, second air flow openings in said top wall and third air flow openings in said lamp socket, whereby cooling air flows through said lamp socket and said lamp plug and over said discharge lamps for cooling thereof.

9. A lamp assembly as defined in claim 8 wherein said second air flow openings are integral with said lamp-receiving openings.

10. A lamp assembly as defined in claim 8 wherein said plurality of discharge lamps includes a red discharge lamp, a green discharge lamp and a blue discharge lamp.

11. A lamp assembly as defined in claim 8 wherein said lamp socket includes an upstanding locating projection and wherein said base includes a recess for receiving said locating projection.

12. A lamp assembly as defined in claim 8 further including spring means for retaining said lamp plug and said lamp socket in an interconnected configuration.

13. A lamp assembly for use as a picture element in an information display system, comprising:

a plurality of low pressure arc discharge lamps for selectively generating multiple colors, each discharge lamp having electrical leads extending from a first end thereof and a light output region at a second end thereof;

a lamp plug for interconnection and mounting of said discharge lamps, comprising a base having spaced-apart electrical connector pins mounted therein, and a cap attached to said base, said cap having a top wall provided with lamp-receiving openings and sidewalls interconnecting said top wall and said base, the first ends of said discharge lamps extending through said openings into said lamp plug, the electrical leads of said discharge lamp being coupled to said electrical connectors for energizing said discharge lamps; and a lamp socket for attachment of said lamp plug, said lamp socket including circuit board-mountable electrical contacts for interconnection with the connector pins of said lamp plug, said lamp socket including an upstanding locating projection, and said base including a recess for receiving said locating projection.

14. A lamp assembly as defined in claim 13 wherein said lamp plug and said lamp socket each include means for directing cooling air over said discharge lamps.

* * * * *